US009610600B2

(12) United States Patent
Ciavarella et al.

(10) Patent No.: US 9,610,600 B2
(45) Date of Patent: Apr. 4, 2017

(54) DISPENSER PUMP USING ELECTRICALLY ACTIVATED MATERIAL

(71) Applicant: GOJO Industries, Inc., Akron, OH (US)

(72) Inventors: Nick Ermanno Ciavarella, Seven Hills, OH (US); Jackson William Wegelin, Stow, OH (US)

(73) Assignee: GOJO INDUSTRIES, INC., Akron, OH (US)

( * ) Notice: Subject to any disclaimer, the term of this patent is extended or adjusted under 35 U.S.C. 154(b) by 0 days.

(21) Appl. No.: 14/489,850

(22) Filed: Sep. 18, 2014

(65) Prior Publication Data

US 2015/0083756 A1 Mar. 26, 2015

Related U.S. Application Data

(60) Provisional application No. 61/880,270, filed on Sep. 20, 2013.

(51) Int. Cl.
*F04B 43/02* (2006.01)
*B05B 11/00* (2006.01)
(Continued)

(52) U.S. Cl.
CPC ..... *B05B 11/3028* (2013.01); *A47K 5/1208* (2013.01); *A47K 5/1211* (2013.01);
(Continued)

(58) Field of Classification Search
CPC ..... F04B 43/09; F04B 43/095; F04B 43/046; F04B 43/04; A47K 5/1217; A47K 5/1211;
(Continued)

(56) References Cited

U.S. PATENT DOCUMENTS 4,042,153 A * 8/1977 Callahan ..... B01J 2/02 222/207
4,121,584 A * 10/1978 Turner ..... A61M 5/16809 128/DIG. 13
(Continued)

FOREIGN PATENT DOCUMENTS

WO 2006080566 A1 8/2006
WO 2010143084 A1 12/2010

OTHER PUBLICATIONS

International Search reported and written opinion dated Feb. 6, 2015, 11 pages.
(Continued)

*Primary Examiner* — Paul R Durand
*Assistant Examiner* — Charles P Cheyney
(74) *Attorney, Agent, or Firm* — Cooper Legal Group, LLC

(57) ABSTRACT

Apparatuses and techniques are provided for dispensing fluid from a dispenser that includes a flexible membrane having different levels of pliability according to a voltage applied to the flexible membrane. According to some embodiments, a biasing device, such as a spring, is disposed on a first side of the flexible membrane and is configured to apply pressure to the flexible membrane. When a first voltage is applied to the flexible membrane, the flexible membrane becomes sufficiently pliable to enable the spring to flex the flexible membrane, pushing the flexible membrane into a pumping chamber disposed on the opposite side of the flexible membrane relative to the spring. The fluid is stored in the pumping chamber and the flexing of the flexible membrane causes the pumping chamber to compress. Such compression of the pumping chamber forces the pumping chamber to dispense the fluid through a pump outlet.

18 Claims, 5 Drawing Sheets

(51) Int. Cl.
*B65D 83/00* (2006.01)
*A47K 5/12* (2006.01)
*F04B 43/04* (2006.01)

(52) U.S. Cl.
CPC ..... *A47K 5/1217* (2013.01); *B65D 83/0055* (2013.01); *F04B 43/02* (2013.01); *F04B 43/04* (2013.01)

(58) Field of Classification Search
CPC ..... A47K 5/1208; B65D 83/0055; B05B 11/3028
USPC ..... 222/181.1–181.3, 207, 214, 212, 494, 222/213, 181.1–181.2, 209; 417/413.1–413.3; 310/800, 309, 311; 251/129.01, 129.02, 129.06
See application file for complete search history.

(56) References Cited

U.S. PATENT DOCUMENTS 4,231,287 A * 11/1980 Smiley ..... F04B 43/0054 417/413.1
4,303,376 A * 12/1981 Siekmann ..... A61M 5/14224 417/360
4,453,931 A * 6/1984 Pastrone ..... A61M 5/14224 417/38
4,479,761 A * 10/1984 Bilstad ..... A61M 1/3496 128/DIG. 12
5,088,515 A * 2/1992 Kamen ..... A61M 39/22 137/15.17
5,452,878 A * 9/1995 Gravesen ..... F15C 5/00 251/129.01
6,017,117 A * 1/2000 McClelland ..... B41J 2/14072 347/84
6,071,088 A 6/2000 Bishop et al.
7,258,533 B2 * 8/2007 Tanner ..... F04B 43/046 137/855
7,806,301 B1 10/2010 Ciavarella et al.
2002/0013545 A1 * 1/2002 Soltanpour ..... A61F 9/00781 604/9
2003/0214199 A1 * 11/2003 Heim ..... F04B 35/045 310/309
2005/0045480 A1 3/2005 Krumme
2009/0148318 A1 * 6/2009 Kamitani ..... F04B 43/04 417/413.2
2009/0196778 A1 * 8/2009 Kitahara ..... F04B 43/046 417/540
2010/0221124 A1 9/2010 Ikushima et al.
2012/0158193 A1 6/2012 De Rosa et al.

OTHER PUBLICATIONS

Thummala, et al., "Analysis of Dielectric Electro Active Polymer Actuator and its High Voltage Driving Circuits", Published in: Power Modulator and High Voltage Conference (IPMHVC), 2012 IEEE International, pp. 458-461, Jun. 3-7, 2012, http://ieeexplore.ieee.org/xpl/login.jsp?tp=&arnumber=6518779 &url=http%3A%2F%2Fieeexplore.ieee.org%2Fxpls%2Fabs_all.jsp%3Farnumber%3D6518779.

* cited by examiner

DISPENSER PUMP USING ELECTRICALLY ACTIVATED MATERIAL

RELATED APPLICATIONS

This application is a non-provisional filing of and claims priority to U.S. Provisional Application 61/880,270, titled "DISPENSER PUMP USING ELECTRICALLY ACTIVATED MATERIAL" and filed on Sep. 20, 2013, which is incorporated herein by reference.

FIELD OF THE INVENTION

The current invention pertains to pumping mechanisms used in fluid product dispensers, and more specifically to pumping mechanisms that use electrically activating polymers to pressurize a fluid chamber for dispensing fluid product through a nozzle.

BACKGROUND OF THE INVENTION

It is known in the art to dispense hand care products from a dispenser mounted to a wall or stand. Such dispensers typically have a replaceable reservoir containing hand soap, lotion or sanitizer. Some models dispense product automatically by sensing when a person's hand has been placed under the dispenser. The sensor sends signals to a controller, which in turn operates a pump that forces fluid through a nozzle and onto the person's hand.

Dispensers may be conveniently located in building entrances, bathrooms, or lunchrooms providing convenient accessibility to passersby. However, not all areas are appropriately suited for supplying power to dispensers. As such, dispensers are typically equipped with an onboard power source, typically batteries.

However, drain on the batteries can be significant. Pumps are actuated by motors, which include gears or other forms of transmission inherently possessing significant power losses. Sensors and control circuitry add additional drain to the onboard power source. Thus, frequent maintenance of the automatic dispensers is needed and cost is incurred with the regular replacement of batteries.

Moreover, traditional pump actuators are relatively large, precluding the use of automatic dispensers in areas where limited space is available.

It would therefore be advantageous to provide an automatic dispenser having a low power consumption profile and a small foot print, while maintaining the functional benefits of a touch-less dispenser. The present invention obviates the aforementioned problems.

DETAILED DESCRIPTION

Figure 1:
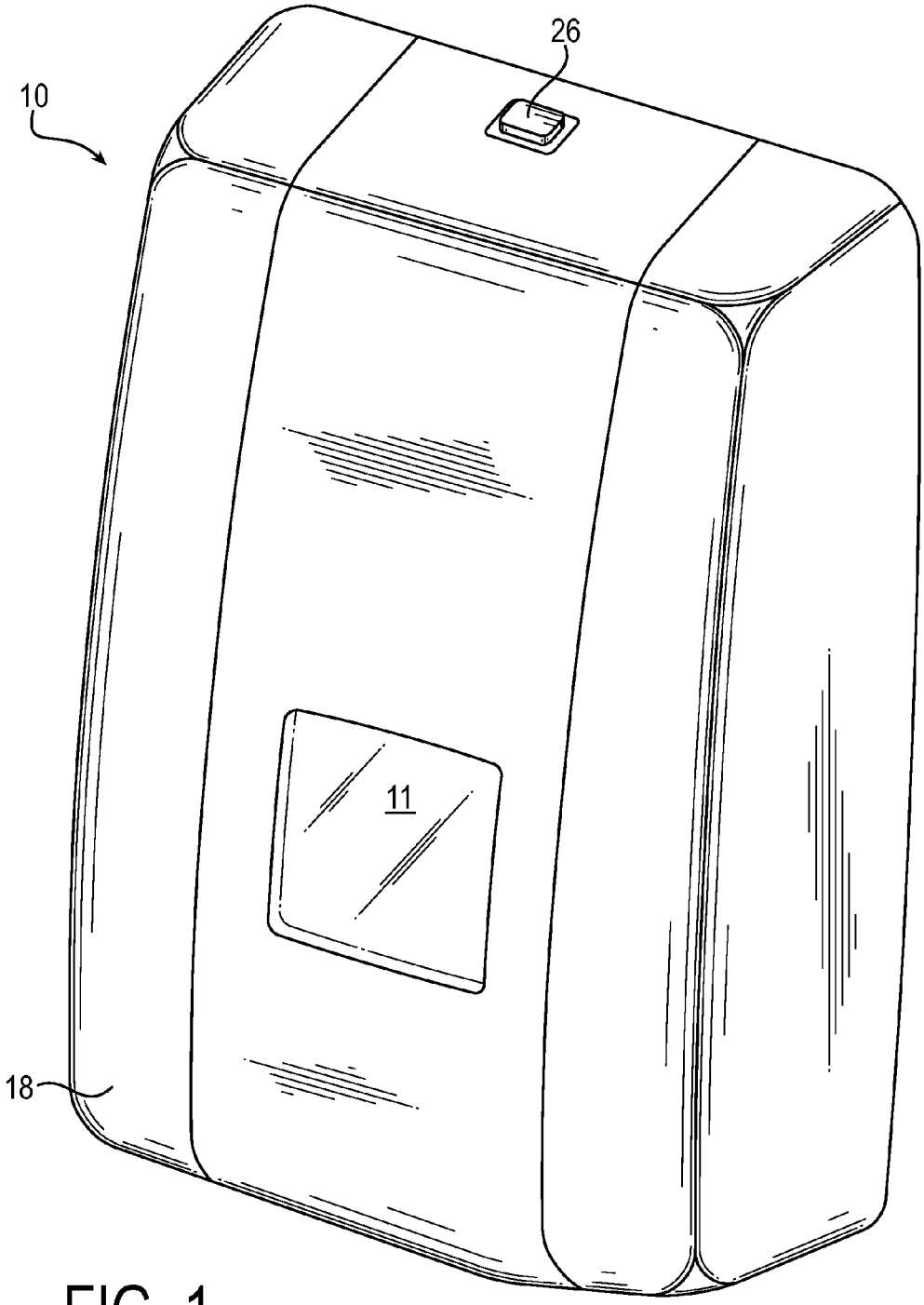
FIG. 1 is a perspective view of a fluid product dispenser according to the embodiments of the present invention.

With reference to FIG. 1, a product dispenser according to the embodiments of the present invention is shown and indicated generally at 10. Dispenser 10 meters out product, which may include hand care products like soap, lotions or sanitizers, although other types of fluid products may be dispensed from the product dispenser.

Figure 2:
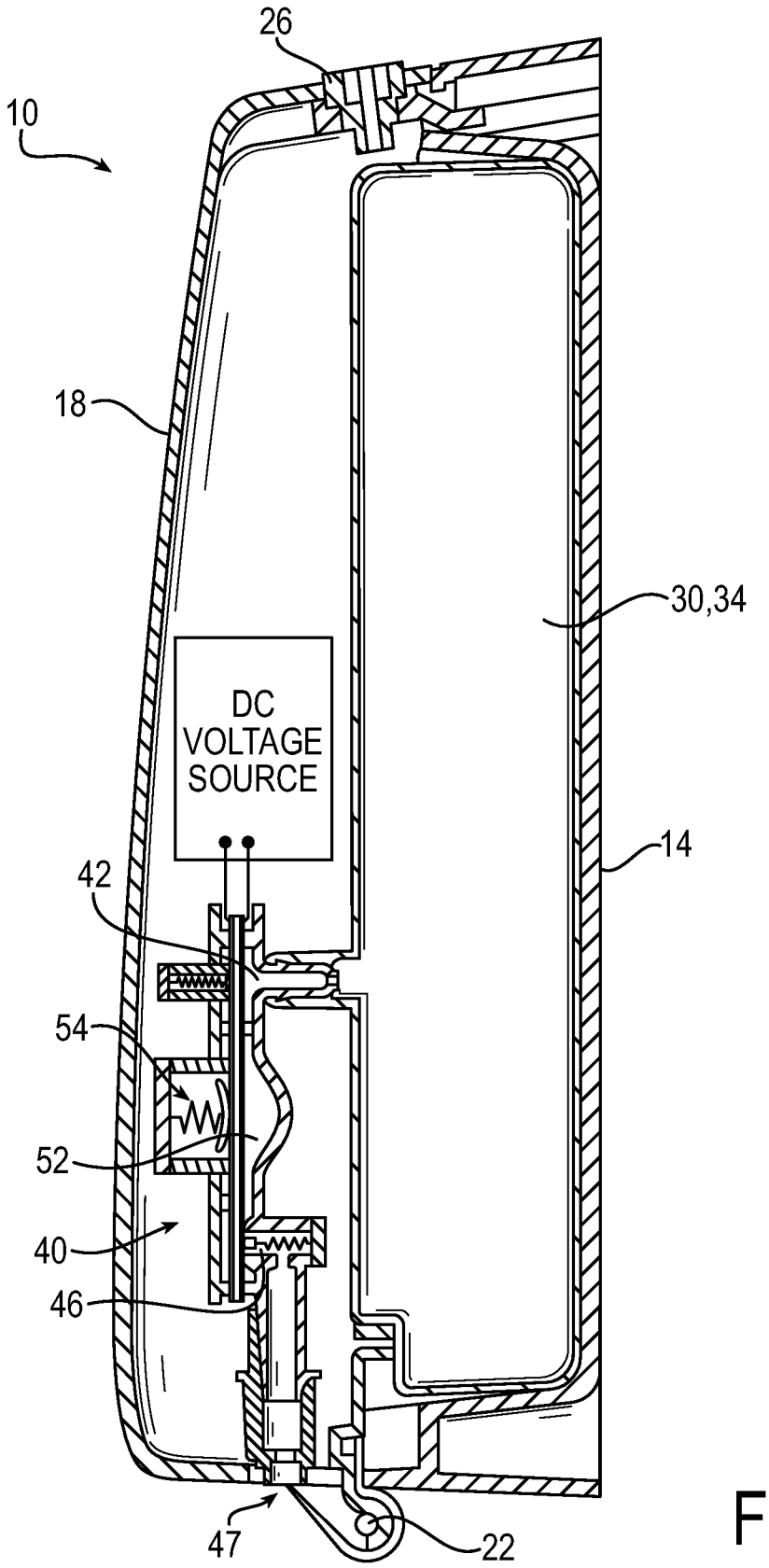
FIG. 2 is a cross-sectional view of the fluid product dispenser showing the internal components of the dispenser.

Referencing FIGS. 1 and 2, dispenser 10 includes a base 14 and a cover 18 which when closed define an internal area that holds the components of the dispenser 10. The base 14 may be generally rigid having a structural configuration suitable for supporting a pump and a fluid reservoir 30, as well as other components to be discussed later. The dispenser 10 can be mounted to a wall, stand or other structure, not shown in the figures, and so the base 14 includes mounting holes or brackets capable of receiving one or more fasteners. The base 14 may further include a hinge 22 onto which the cover 18 is pivotally attached. A latch 26 secures the 18 cover in place and manually releases to allow access to the interior region of the dispenser 10. In one exemplary manner, the cover 18 may be generally concave and may include a window 11 positioned to allow service personnel visual access to the fluid reservoir 30.

Still referencing FIG. 2, fluid reservoir 30 is constructed to contain hand care products. The reservoir 30 may be a reusable container and refilled with product as needed. Alternatively, the reservoir 30 may be disposable and replaced when empty. Access to the reservoir 30 is gained by unlatching and pivoting the cover 18 away from the base 14 thereby exposing the interior of the dispenser 10. In one embodiment, the reservoir 30 may held in place by a ledge and/or wall extended from the base 14. Generally, the reservoir 30 is removed and replaced with another reservoir 30 for sanitary reasons. Such replaceable reservoirs are referred to hereafter as refill units 34.

The refill unit 34 may be constructed from pliable sheet-like material, referred to as a bag, and may include an outlet attached to a side or an end of the bag. Still other refill units 34 may be constructed from generally rigid or semi-rigid plastic for use in an upright or an inverted mounting configuration. In FIG. 2, the refill unit 34 is stored completely within the dispenser housing. However, other structural and mounting configurations for the refill unit 34 may be selected without departing from the intended scope of coverage of the embodiments of the present invention.

Figure 3:
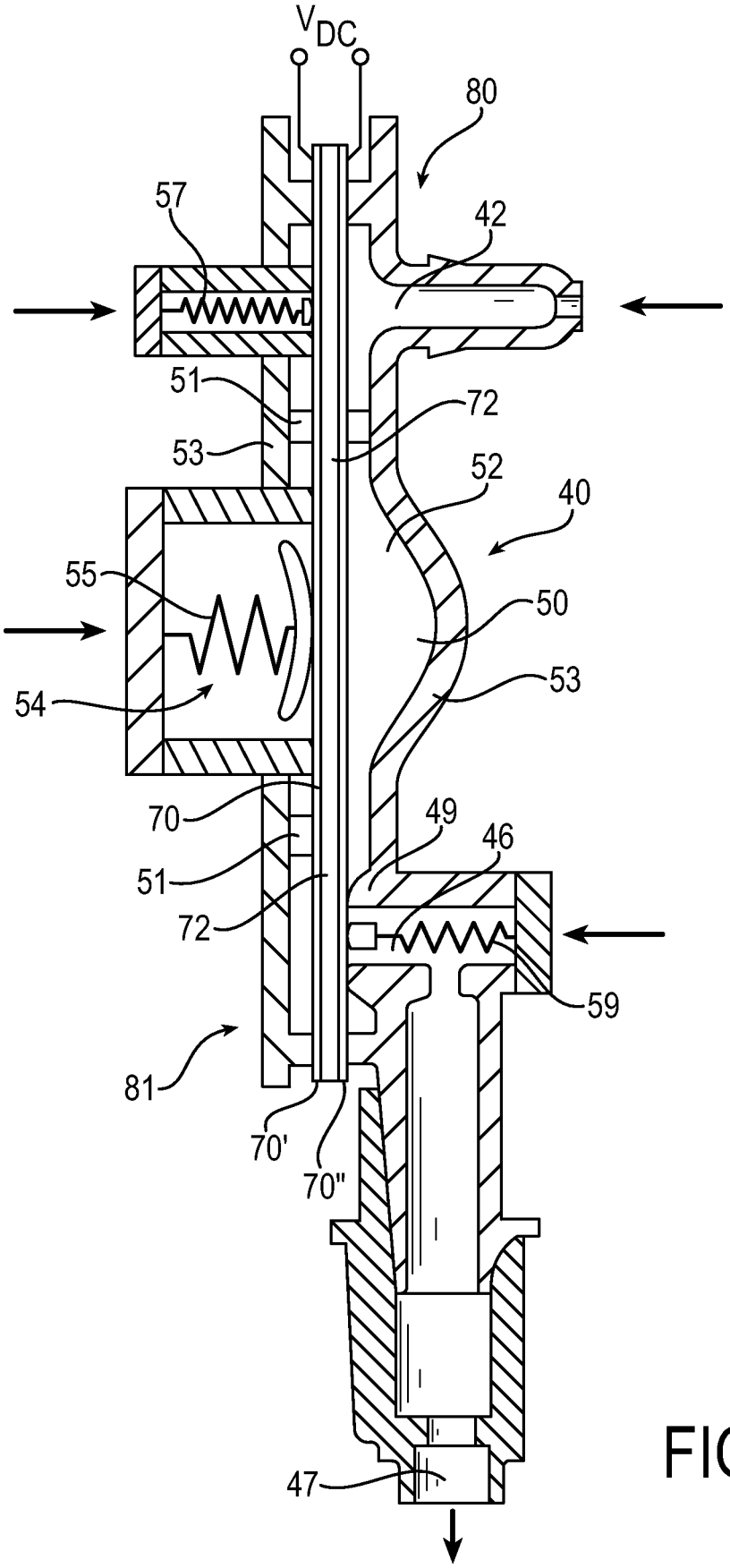
FIG. 3 is a cross-sectional view showing a schematic representation of a fluid product pump in the electrically de-energized state according to the embodiments of the present invention.

Referring now to FIGS. 2 and 3, an exemplary embodiment of a dispenser pump 40 is shown having a pump inlet 42 and a pump outlet 46. The pump outlet 46 is connected to a nozzle 47 for dispensing fluid product from the dispenser 10. The pump inlet 42 is fluidly connected to the refill unit 34. More specifically, the pump inlet 42 is connected to an end of the refill unit 34 to minimize waste. In one embodiment, the pump 40 is disposable and is provided attached to the refill unit 34 as an assembly. In this manner, every wetted component of the dispenser 10 is disposed of when the refill unit 34 is replaced.

Still referencing FIG. 3, pump 40 includes a pumping chamber shown generally at 50. In the embodiment currently described, pumping chamber 50 has a generally concave region 52. Inlet 42 extends from a top side of the concave region 52 and outlet 46 extends from the distal bottom end of the concave region 52, although other positions of the inlet and outlet relative to the pumping chamber 50 may be chosen with sound judgment. In this way, gravity assists in drawing product from the refill unit 34 into the concave region 52. An actuator, discussed in detail below, pressurizes chamber 50 thereby expelling product through the outlet 46 and the nozzle 47. It will be appreciated that other configurations of pumping chambers 50 may be used without departing from the intended scope of coverage of the embodiments of the present invention.

Fluid in the pumping chamber 50 may be pressurized by displacing one or more walls that make up the pumping chamber 50. In the preferred embodiment, chamber 50 may be constructed from one or more rigid wall sections 53 and by a flexible membrane 70. Pressure is generated in the concave region 52 from a biasing device 54 located adjacent the flexible membrane 70. In one embodiment, biasing device 54 comprises a leaf spring, or a coil spring 55. However, other types of springs or biasing devices may be used. Force from the biasing device 54 pushes against the membrane 70 constricting the volume of fluid in the chamber 50 thereby pressurizing the product inside.

With continued reference to FIG. 3, membrane 70 is constructed from flexible polymeric material. The flexible material possesses memory and has a predetermined stiffness, i.e. resistance to bending. In one embodiment, membrane 70 is made from Silicone, or alternatively from Polyurethane. However, it should be construed that other types of material that have the requisite characteristics of stiffness and memory may be used as needed for operation of the pump 40. Accordingly, after membrane 70 is displaced, i.e. biased by device 54, it will tend to retain its original shape and return to its unbiased configuration when the force is removed. It will be appreciated that the spring constants of the biasing device 54 may be matched to the stiffness of the membrane 70 in a manner suitable for operation of the dispenser 10 as described herein.

The membrane 70 further includes electrically conductive material applied to each of its opposing faces 70', 70". In one embodiment, the electrically conductive material comprises carbon particles adhered to the surface of the membrane in a relatively thin layer. Each face 70', 70" of the membrane, and more specifically each of the electrically conductive layers 72, is respectively connected to opposite polarity terminals of a DC voltage power source. When a threshold magnitude of voltage is applied to the membrane 70, its stiffness is altered by the attraction of the conductive layers 72 pressing together. As such, the membrane 70, in effect, temporarily loses some of its stiffness becoming more pliable and therefore subject to displacement from the force of the biasing device 54 (reference FIG. 4). Consequently, when the voltage potential is removed the memory of the base material returns the membrane 70 to its original shape thus overcoming the bias force (reference FIG. 3). It can be readily seen then that energizing and de-energizing the voltage source results in the compression and de-compression of the pumping chamber 50 thereby facilitating pumping of product from the dispenser 10.

It will be understood by persons of skill in the art that the polymeric material of the membrane 70 functions as a dielectric between the electrically conductive layers 72. The polarizing effect of the applied voltage alters the characteristics of membrane 70 as described above. Voltages applied to the membrane 70 may be in the range of 2 kV to 4 kV. However, any range of voltage potential may be applied as is appropriate for use in actuating the pump 40. In that the phenomenon of altering the stiffness of a dielectric polymer by the application of voltage is known in the art, no further explanation will be offered here.

To ensure that product flows properly through the nozzle 47, one or more valves are incorporated into pump 40. In one embodiment, a first valve, shown generally at 80, is fluidly communicated with inlet 42. Additionally, a second valve, shown generally at 81, is fluidly connected to outlet 46. When activated in proper succession, the valves 80, 81 prevent the back flow of product into refill unit 34 and prevent product from leaking through the nozzle before the dispenser is activated.

With reference again to FIGS. 3 and 4, membrane 70 may be used as valves 80, 81 to selectively open and close inlet 42 and outlet 46 as mentioned above. In one embodiment of the present invention, an additional biasing device 57 may be positioned adjacent to membrane 70 and in proximity to inlet 42. When voltage is applied to the conductive layers 72 in a manner previously described, membrane 70 loses stiffness over the entire area covered by the conductive layers 72. Accordingly, membrane 70 becomes more pliable allowing biasing device 57 to press membrane 70 into sealing contact with the inlet 42 thereby preventing fluid flow back into the refill unit 34.

It is noted that biasing devices 54 and 57 displace membrane 70 at the same time. Accordingly, it is contemplated in an alternate embodiment that one single biasing device, not shown in the figures, may be used to both displace fluid from the pumping chamber 50 and seal the inlet 42. Thus the biasing device may be specifically configured and the inlet 42 may be positioned proximal to the pumping chamber to facilitate both actions with a single biasing element.

Figure 4:
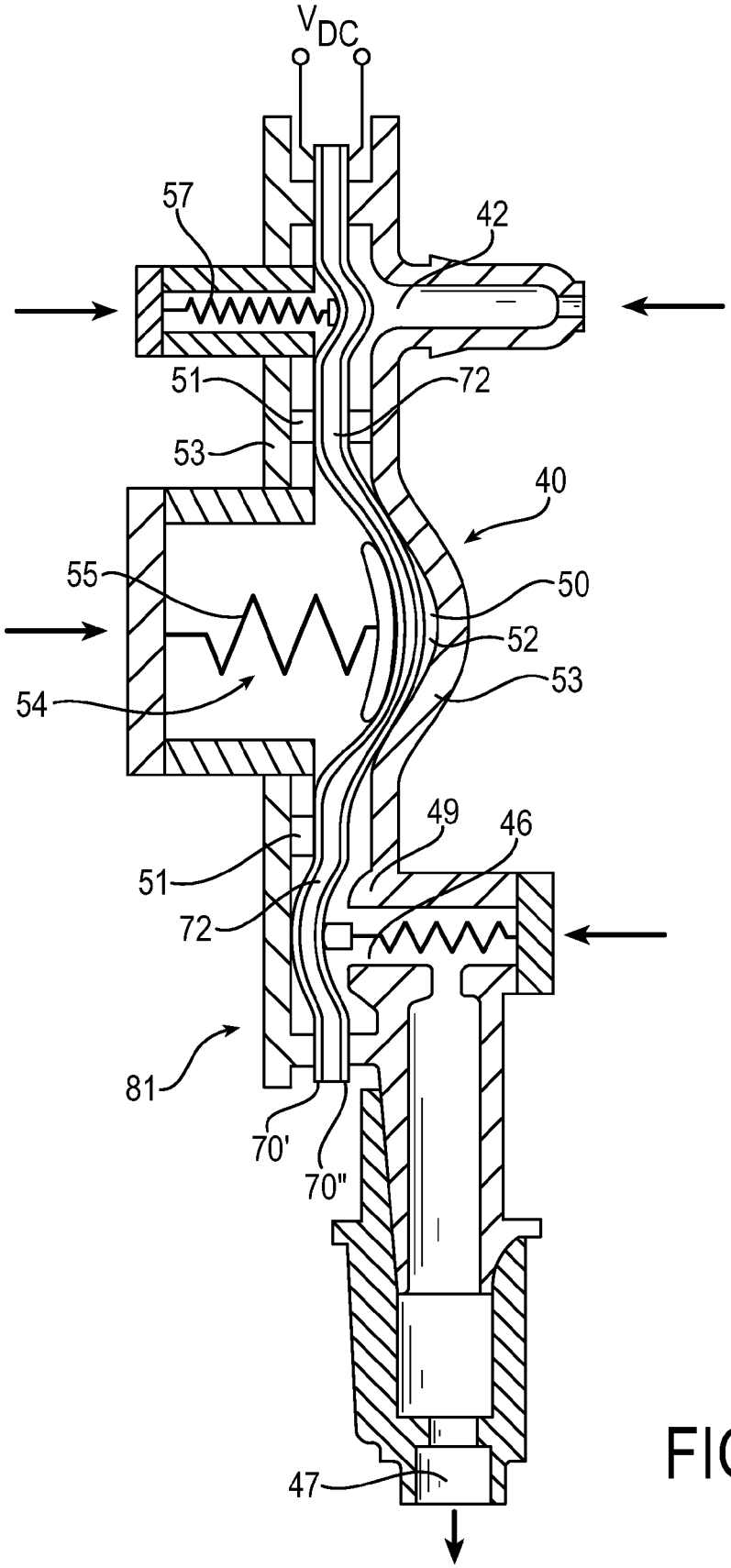
FIG. 4 is a cross-sectional view showing a schematic representation of a fluid product pump in the electrically energized state according to the embodiments of the present invention.

Referring still to FIGS. 3 and 4, another separate biasing device 59 may be included and positioned to engage membrane 70 at the location of the outlet 46. It is noted that the inlet 42 and outlet 46 must be fluidly sealed at opposite times during operation of the pump 40. Hence, biasing device 59 is positioned to move membrane 70 away from the outlet 46 when fluid in the pumping chamber 50 is pressurized. It follows that, in the de-energized state, membrane 70 is configured to cover the outlet 46 thereby preventing fluid flow therethrough.

Figure 5:
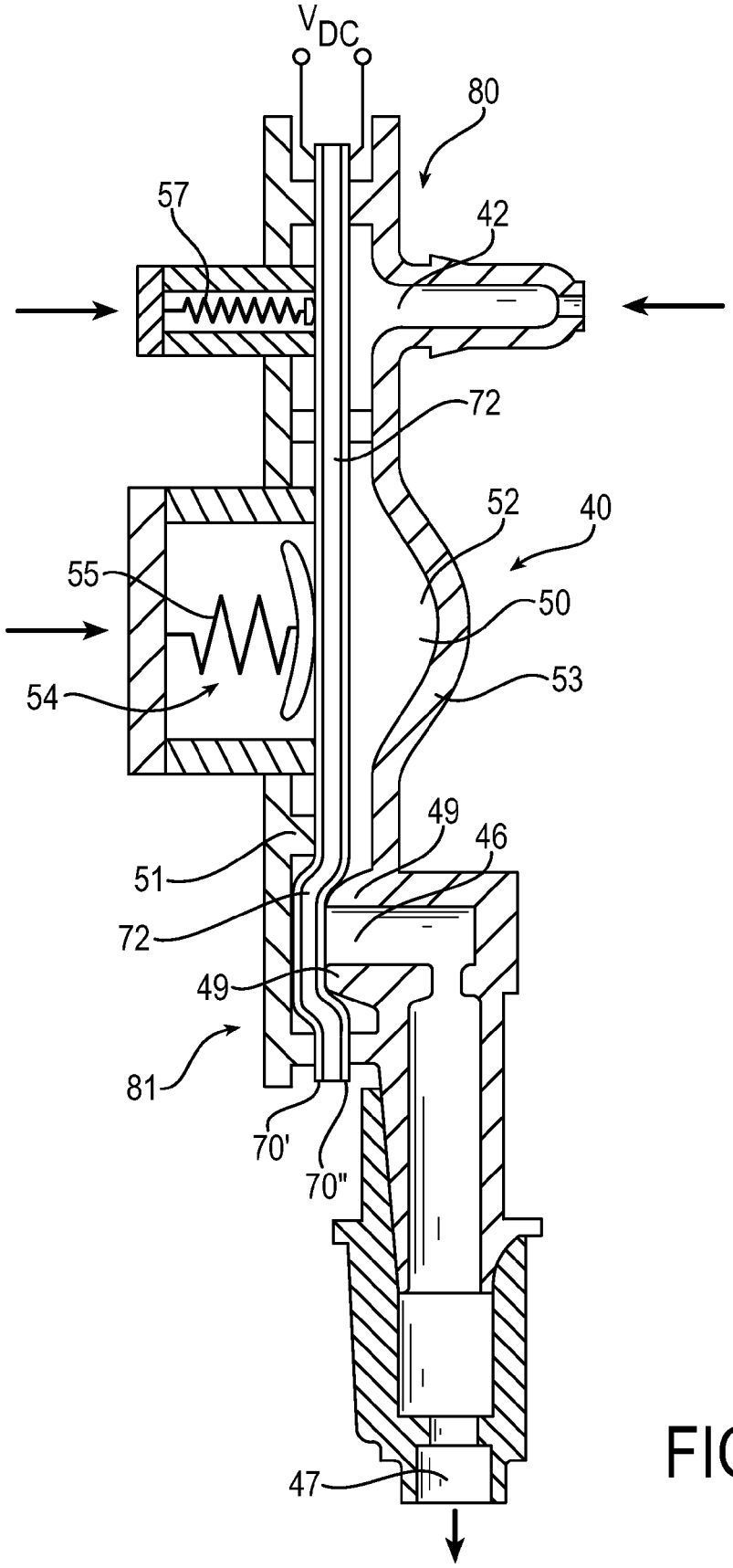
FIG. 5 is a cross-sectional view showing a schematic representation of another embodiment of the fluid product pump according to the embodiments of the present invention.

With reference now to FIGS. 3 and 5, to ensure against leaks through outlet 46 in the de-energized state, a raised rim 49 may be positioned around the opening of the outlet 46. Additionally, protrusions, referred to herein as ribs 51, may be fashioned to extend from the one or more rigid wall sections 53 opposite that of the raised rim 49. In this way, the stiffness and memory of the membrane 70 force it into contact with the outlet 46 in a crimping action (reference FIG. 5).

It will be appreciated that pressurized fluid will act on the membrane 70 to move it out of engagement with the outlet 46. As such, FIG. 5 depicts an embodiment of the present invention that does not include a dedicated biasing device to force the membrane 70 out of engagement with the outlet 46. Accordingly, the stiffness and/or thickness of the membrane 70 may be selected so that as pressure in the pumping chamber 50 increases, a threshold is reached that overcomes the rigidity of the membrane 70 thus allowing fluid to flow through the nozzle 47. While the current embodiment depicts both rim 49 and ribs 51, variations are contemplated excluding one or the other of these components.

Having illustrated and described the principles of this invention in one or more embodiments thereof, it should be readily apparent to those skilled in the art that the invention can be modified in arrangement and detail without departing from such principles.

What is claimed is:

1. A pump for dispensing fluid from a fluid reservoir of a dispenser, comprising:

a pump inlet through which the fluid is received from the fluid reservoir, the pump inlet extending along a first axis;

a pumping chamber for storing the fluid received through the pump inlet;

a flexible membrane for selectively compressing the pumping chamber, the flexible membrane having a first pliability when a first voltage is applied to the flexible membrane and having a second pliability when a second voltage is applied to the flexible membrane;

a mechanical biasing device for applying a pressure to the flexible membrane, the pressure flexing the flexible membrane, when the flexible membrane has the first pliability, to compress the pumping chamber;

a second mechanical biasing device for applying a second pressure to the flexible membrane along a second axis that is substantially parallel to the first axis, the second mechanical biasing device disposed diametrically opposite the pump inlet relative to the flexible membrane, the second pressure flexing the flexible membrane, when the flexible membrane has the first pliability, to seal the pump inlet;

a pump outlet through which the fluid is dispensed when the pumping chamber is compressed; and a third mechanical biasing device for applying a third pressure to the flexible membrane, the third mechanical biasing device disposed adjacent to the pump outlet relative to the flexible membrane, the third pressure flexing the flexible membrane, when the flexible membrane has the first pliability, to open the pump outlet;

wherein the flexible membrane has a first side, to which the mechanical biasing device applies the pressure and to which the second mechanical biasing device applies the second pressure, and a second side, on which the pump inlet, the pumping chamber, and the pump outlet are located and to which the third mechanical biasing device applies the third pressure.

2. The pump of claim 1, the pressure insufficient to flex the flexible membrane when the flexible membrane has the second pliability.

3. The pump of claim 2, the flexible membrane forming a wall of the pumping chamber.

4. The pump of claim 1, the flexible membrane comprising:

a polymeric material;

a first electrically conductive material disposed at a first face of the polymeric material; and a second electrically conductive material disposed at a second face of the polymeric material, the second face diametrically opposing the first face.

5. The pump of claim 4, the polymeric material comprising a dielectric material.

6. The pump of claim 4, comprising a direct current (DC) voltage source for applying at least one of the first voltage or the second voltage, the first electrically conductive material connected to a first terminal of the DC voltage source and the second electrically conductive material connected to a second terminal of the DC voltage source, the second terminal having a polarity that is opposite a polarity of the first terminal.

7. The pump of claim 1, the second voltage corresponding to a voltage of 0 Volts.

8. The pump of claim 1, the mechanical biasing device disposed diametrically opposite the pumping chamber relative to the flexible membrane.

9. The pump of claim 1, comprising:

a raised rim disposed along a fluid pathway between the pumping chamber and the pump outlet, the raised rim in contact with the flexible membrane while the flexible membrane has the second pliability to seal the pump outlet.

10. The pump of claim 1, the flexible membrane having a first shape prior to application of the first voltage and the flexible membrane configured to return to the first shape responsive to the second voltage being applied.

11. The pump of claim 1, the mechanical biasing device comprising a spring.

12. A pump for dispensing fluid from a fluid reservoir of a dispenser, comprising:

a pump inlet through which the fluid is received from the fluid reservoir;

a pumping chamber for storing the fluid received through the pump inlet;

a flexible membrane for compressing the pumping chamber, the flexible membrane having a first pliability when a first voltage is applied to the flexible membrane and having a second pliability when a second voltage is applied to the flexible membrane;

a mechanical biasing device for applying a pressure to the flexible membrane, the pressure flexing the flexible membrane, when the flexible membrane has the first pliability, to compress the pumping chamber;

a pump outlet through which the fluid is dispensed when the pumping chamber is compressed; and a third mechanical biasing device for applying a third pressure to the flexible membrane, the third mechanical biasing device disposed adjacent to the pump outlet relative to the flexible membrane, the third pressure flexing the flexible membrane, when the flexible membrane has the first pliability, to open the pump outlet;

wherein the flexible membrane has a first side, to which the mechanical biasing device applies the pressure, and a second side, on which the pump inlet, the pumping chamber, and the pump outlet are located and to which the third mechanical biasing device applies the third pressure.

13. The pump of claim 12, the flexible membrane comprising a dielectric material;

a first electrically conductive material disposed at a first face of the dielectric material; and a second electrically conductive material disposed at a second face of the dielectric material, the second face diametrically opposing the first face.

14. The pump of claim 12, comprising:

a second mechanical biasing device for applying a second pressure to the flexible membrane, the second mechanical biasing device disposed diametrically opposite the pump inlet relative to the flexible membrane, the second pressure flexing the flexible membrane, when the flexible membrane has the first pliability, to seal the pump inlet.

15. The pump of claim 12, the mechanical biasing device disposed diametrically opposite the pumping chamber relative to the flexible membrane.

16. The pump of claim 12, the pump outlet defined by an opening in a raised rim that is sealed by the flexible membrane when the flexible membrane has the second pliability.

17. The pump of claim 16, the third mechanical biasing device extending through the opening in the raised rim when the flexible membrane has the first pliability and the third pressure flexes the flexible membrane to open the pump outlet.

18. The pump of claim 12, the pump inlet extending along a first axis, the pump outlet extending along a third axis, wherein the first axis and the third axis are parallel and non-collinear.

* * * * *